US011272773B2

(12) United States Patent
Wesley

(10) Patent No.: US 11,272,773 B2
(45) Date of Patent: Mar. 15, 2022

(54) COMBINATION MANICURE AND PEDICURE STATION

(71) Applicant: Patricia A. Wesley, Sherwood, AR (US)

(72) Inventor: Patricia A. Wesley, Sherwood, AR (US)

( * ) Notice: Subject to any disclaimer, the term of this patent is extended or adjusted under 35 U.S.C. 154(b) by 1033 days.

(21) Appl. No.: 15/884,856

(22) Filed: Jan. 31, 2018

(65) Prior Publication Data

US 2018/0235342 A1 Aug. 23, 2018

Related U.S. Application Data

(60) Provisional application No. 62/461,094, filed on Feb. 20, 2017.

(51) Int. Cl.

| | |
|---|---|
| ***A45D 29/18*** | (2006.01) |
| ***A47B 83/04*** | (2006.01) |
| ***A47B 5/04*** | (2006.01) |
| ***A47B 81/00*** | (2006.01) |
| *A47B 37/00* | (2006.01) |
| *A47B 9/08* | (2006.01) |

(52) U.S. Cl.

CPC ..... *A45D 29/18* (2013.01); *A47B 5/04* (2013.01); *A47B 81/00* (2013.01); *A47B 83/045* (2013.01); *A47B 9/08* (2013.01); *A47B 37/00* (2013.01); *A47B 2200/0042* (2013.01)

(58) Field of Classification Search

CPC ..... A47D 29/18; A45D 29/18; A47B 5/04; A47B 81/00; A47B 83/045; A47B 9/08; A47B 37/00; A47B 2200/0042

USPC ..... 312/237, 313, 314; 108/134, 152, 6, 7, 108/9, 10

See application file for complete search history.

(56) References Cited

U.S. PATENT DOCUMENTS

| | | | | |
|---|---|---|---|---|
| 169,028 | A | * | 10/1875 | Nicols |
| 591,574 | A | * | 10/1897 | Smith |
| 811,480 | A | * | 1/1904 | Camfield |

(Continued)

FOREIGN PATENT DOCUMENTS

| | | | |
|---|---|---|---|
| DE | 2221430 | * | 11/1973 |
| DE | 9405163 | * | 5/1994 |
| GB | 333712 | * | 8/1930 |

*Primary Examiner* — Janet M Wilkens

(74) *Attorney, Agent, or Firm* — Boudwin Intellectual Property; Daniel Boudwin

(57) ABSTRACT

A combination manicure and pedicure station for performing manicures and pedicures. The combination manicure and pedicure station includes a housing having a top surface, a sidewall forming an enclosed interior volume, and a base. The housing includes at least one drawer slidably mounted within the sidewall thereof. The housing further includes a pedestal mounted to an angled support member, wherein the angled support member is affixed to the top surface. The pedestal includes both a recessed portion that receives a foot and a recessed channel that receives a container therein. The housing further includes a telescopically adjustable stand that is slidably affixed to the sidewall, wherein the stand includes a panel that is hingedly affixed thereto. The panel further includes a cushion member and a recessed channel thereon. Both the top surface of the housing and the panel each include an adjustable light for illuminating an extremity of a user.

19 Claims, 5 Drawing Sheets

(56) References Cited

U.S. PATENT DOCUMENTS 1,813,821 A * 7/1931 Ruebsahm ..... A47B 67/005 312/201
1,853,507 A * 4/1932 Chandler ..... A47B 9/08 312/312
2,171,804 A 9/1939 Fernando
2,352,837 A * 7/1944 Hillenbrand ..... A47B 79/00 108/134
2,666,679 A * 1/1954 Olofsson ..... A47B 79/00 108/10
3,085,842 A 4/1963 Johnson
3,799,487 A * 3/1974 Durrant ..... A47B 29/00 248/447.1
4,280,519 A * 7/1981 Chapman ..... A47B 37/00 132/73.5
4,329,002 A * 5/1982 Cowen ..... A45D 44/02 108/32
5,014,371 A * 5/1991 Heel ..... A45D 19/04 4/516
5,417,168 A * 5/1995 Soper ..... A47B 3/00 108/124
5,722,919 A * 3/1998 Timmer ..... A63B 21/0004 482/105
6,832,688 B1 * 12/2004 Rivera ..... A45D 44/04 132/286
6,899,934 B2 * 5/2005 Beyer ..... G09F 7/12 428/40.1
7,111,852 B2 * 9/2006 Woods ..... B62B 3/00 280/47.34
10,034,806 B1 * 7/2018 Greenhalgh, Sr. ..... A61G 7/05
2004/0045568 A1 3/2004 Abbott et al.
2005/0285489 A1 12/2005 Brother
2009/0030355 A1 * 1/2009 Gay ..... A61H 35/006 601/166
2009/0260647 A1 10/2009 Ionis et al.
2012/0112609 A1 * 5/2012 Ross ..... A47B 23/06 312/7.2
2013/0053677 A1 * 2/2013 Schoenfeld ..... G06T 7/507 600/407
2013/0298926 A1 * 11/2013 Smeragliuolo ..... A45D 29/20 132/75
2017/0071824 A1 * 3/2017 Park ..... A61H 35/006
2017/0169720 A1 * 6/2017 McCarthy ..... G09B 19/0076
2018/0344000 A1 * 12/2018 Humphrey ..... A45D 29/20

* cited by examiner

COMBINATION MANICURE AND PEDICURE STATION

CROSS REFERENCE TO RELATED APPLICATION

This application claims the benefit of U.S. Provisional Application No. 62/461,094 filed on Feb. 20, 2017. The above identified patent application is herein incorporated by reference in its entirety to provide continuity of disclosure.

BACKGROUND OF THE INVENTION

The present invention relates to manicure and pedicure stands. More specifically, the present invention provides a combination manicure and pedicure station for supporting both a foot and a hand of a user on different platforms when performing a manicure and pedicure. The platforms are designed to place the extremity in an operative position during a manicure or pedicure procedure. The preferred embodiment is intended to be used within a residence, specifically when applying nail polish to the fingernails of the hand or to the toenails of the foot. However, the combination manicure and pedicure station may be used within a commercial setting, such as, a nail salon or spa.

Many people enjoy receiving manicures or pedicures to maintain healthy hands and feet. However, these procedures can be expensive when done professionally at a nail salon or spa. Therefore, many people try to create a professionally manicured look for their hands or feet, specifically the fingernails and toenails. Unfortunately, attempting to replicate a professionally manicured look in a home environment can be difficult, frustrating, and time consuming without a proper pedestal for the feet and hands. Accordingly, a device designed to assist a user when manicuring their hands and feet while at home is desired.

Devices have been disclosed in the known art that relate to manicure and pedicure stands. These include devices that have been patented and published in patent application publications. Many of these devices generally relate to pedestals comprising a single platform that can be used for both manicures and pedicures. Some devices include a platform that includes grooves for receiving fingers and the palm of the hand, in order to support the hand while applying nail polish. Other devices include recessed channels that hold various containers, such as, nail polish bottles. Some devices include a bowl for soaking fingers or the toes to treat the cuticles. Lastly, some devices include a light to further illuminated the hand or foot when performing a manicure or pedicure.

However, these known art devices have several drawbacks. Many of these devices fail to provide separate pedestals or platforms for performing a manicure and a pedicure. Further, these known devices fail to include a manicure platform that is adjustable in a vertical and horizontal direction, such that it can provide a comfortable position to a user when performing a manicure. Further, these devices fail to include a recessed area within a pedicure platform configured to receive a foot. Many of these devices lack compartments, such as drawers, for storing manicure and pedicure supplies. Lastly, none of these devices include adjustable lights on separate platforms, used to further illuminate the hands and feet when performing a manicure or pedicure.

In light of the devices disclosed in the known art, it is submitted that the present invention substantially diverges in design elements from the known art and consequently it is clear that there is a need in the art for an improvement to existing manicure and pedicure stands. In this regard the instant invention substantially fulfills these needs.

SUMMARY OF THE INVENTION

In view of the foregoing disadvantages inherent in the known types of manicure and pedicure stands now present in the known art, the present invention provides a new combination manicure and pedicure station wherein the same can be utilized for providing convenience for the user when performing manicures and pedicures.

It is therefore an object of the present invention to provide a new and improved combination manicure and pedicure station that has all of the advantages of the known art and none of the disadvantages.

It is another object of the present invention to provide a combination manicure and pedicure station comprising a housing having a top surface including a sidewall forming an enclosed interior volume and a base, at least one drawer slidably mounted within the housing, a pedestal mounted to an angled support member, wherein the angled support member is affixed to the top surface of the housing, and a stand slidably affixed to the sidewall, wherein the stand includes a panel that is hingedly affixed thereto.

Another object of the present invention is to provide a combination manicure and pedicure station, wherein the pedestal includes a recessed portion configured to receive a foot, wherein the recessed portion includes a cushion member disposed on a sidewall thereof, wherein the cushion member is configured to receive a heel of the foot, and at least one recessed channel configured to receive a container therein.

Another object of the present invention is to provide a combination manicure and pedicure station, wherein the panel includes a plurality of fasteners disposed on a bottom surface thereof, wherein the fasteners are configured to receive an adjustment rod hingedly mounted to the stand, such that the adjustment rod and fasteners are configured to position the panel at various angles.

Another object of the present invention is to provide a combination manicure and pedicure station, wherein the panel further includes an adjustable light configured to illuminate a top surface of the panel, a recessed channel configured to receive a container, and a cushion member disposed at a second end of the panel, wherein the cushion member is configured to receive a wrist of a user.

Yet another object of the present invention is to provide a combination manicure and pedicure station, wherein the stand is telescopically adjustable in height via a plurality of fasteners, such that a first member is received and removably secured within an interior volume of a second member at varying heights, wherein the plurality of fasteners are configured as a spring driven pin and aperture arrangement, wherein the spring driven pin protrudes from the second member and is received by an aperture disposed within the first member.

Another object of the present invention is to provide a combination manicure and pedicure station that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
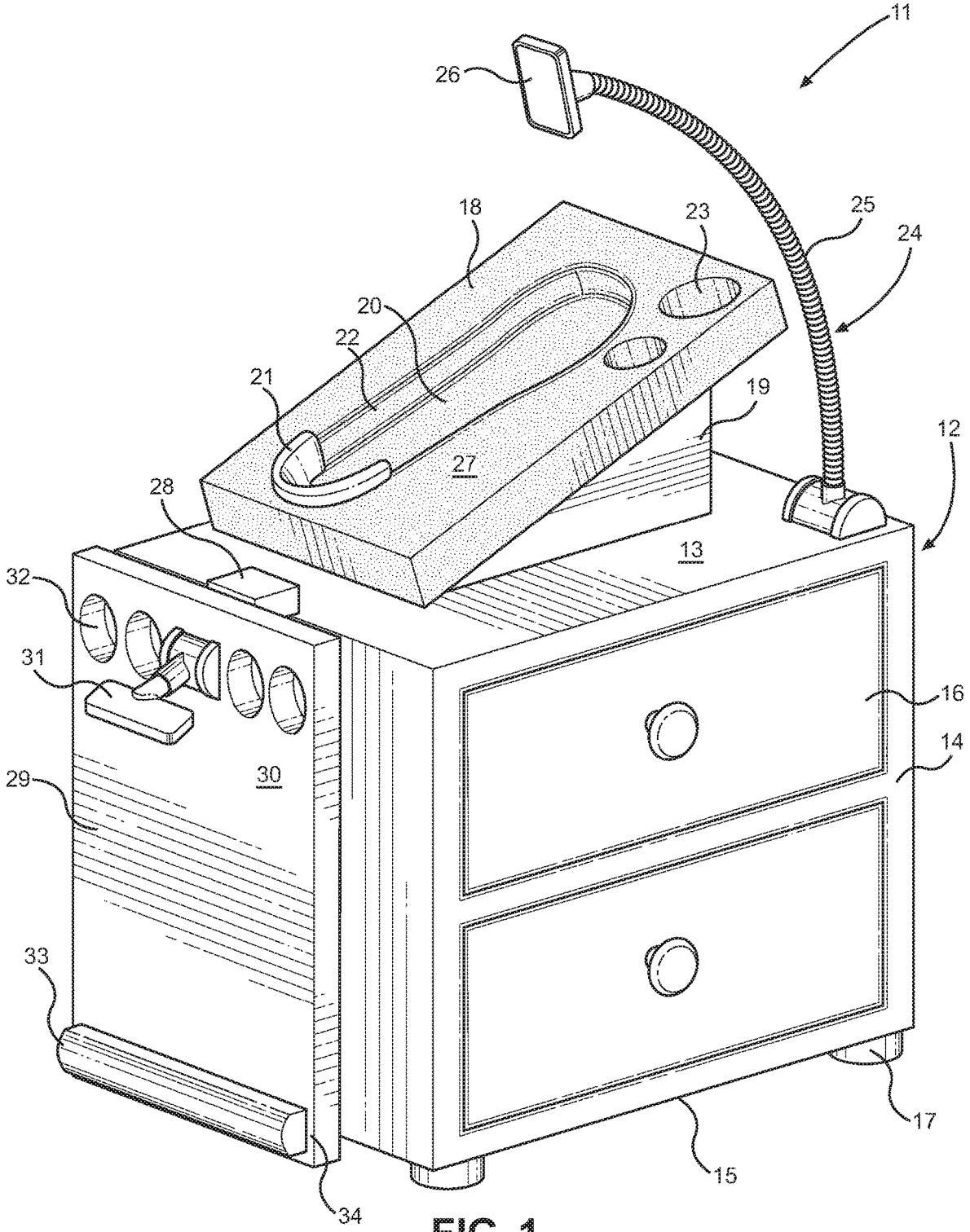
FIG. 1 shows a perspective view of an embodiment of the combination manicure and pedicure station, wherein the panel is in a stored configuration.

Reference is made herein to the attached drawings. Like reference numerals are used throughout the drawings to depict like or similar elements of the combination manicure and pedicure station. For the purposes of presenting a brief and clear description of the present invention, the preferred embodiment will be discussed as used for performing a manicure and a pedicure on a hand and a foot of a user, respectively. The figures are intended for representative purposes only and should not be considered to be limiting in any respect.

Referring now to FIG. 1, there is shown a perspective view of an embodiment of the combination manicure and pedicure station, wherein the panel is in a stored configuration. The combination manicure and pedicure station 11 comprises a housing 12 having a top surface 13 including a sidewall 14 forming an enclosed interior volume and a base 15. In the illustrated embodiment, the housing 12 comprises a rectangular shape. However, the housing 12 can be any suitable shape, such as circular, square, or oval. The housing 12 includes at least one drawer 16 slidably mounted within the sidewall 14 of the housing 12. In the illustrated embodiment, the housing 12 includes two slidably mounted drawers 16. However, in alternative embodiments, the housing 12 may include additional drawers 16 of varying size to accommodate storage of various beauty supplies. In the illustrated embodiment, the base 15 of the housing further includes a plurality of footings 17 disposed on a bottom surface thereof. In some embodiments, the plurality of footings 17 are adjustable in height, such that the combination manicure and pedicure station 11 can be leveled on a ground.

The combination manicure and pedicure station 11 includes a pedestal 18 that is mounted to an angled support member 19. The angled support member 19 is affixed to the top surface 13 of the housing 12 and is configured to position the pedestal 18 at an angle. In the illustrated embodiment, the pedestal 18 further includes a recessed portion 20 configured to receive a foot. The recessed portion 20 includes a cushion member 21 disposed on a first sidewall 22 thereof, wherein the cushion member 21 is configured to receive a heel of the foot. The pedestal 18 further includes at least one recessed channel 23 configured to receive a container. In the illustrated embodiment, the pedestal 18 includes two recessed channels 23 with varying diameters. The recessed channels 23 are used to secure various beauty products, such as, nail polish bottles. The recessed channels 23 provide easy access to products for a user when performing a pedicure.

In the illustrated embodiment, the top surface of the housing 13 further includes a first adjustable light 24 that includes an adjustable neck 25 and a light source 26, such that the light source 26 can be positioned to illuminate a top surface 27 of the pedestal 18. In alternate embodiments, the light 24 is positioned on other structures of the station 11, such as, directly on the pedestal 18.

The combination manicure and pedicure station 11 further comprises a stand 28 slidably affixed to the sidewall 14, wherein the stand 28 includes a panel 29 that is hingedly affixed thereto. The panel 29 is configured to rotate about a first end of the stand 28, such that the panel 29 can be positioned in a stored configuration and an extended configuration. In the illustrated embodiment, the stand 28 is disposed on a sidewall orthogonal to the drawer 16. However, the stand 28 may be disposed on the housing 12 in any suitable position.

In the illustrated embodiment, a top surface 30 of the panel 29 includes a second adjustable light 31 and at least one recessed channel 32 configured to receive a container therein. The second adjustable light 31 is configured to illuminate the top surface 30 of the panel 29. In the illustrated embodiment, the panel 29 includes four recessed channels 32. However, in alternative embodiments, the panel 29 may include any suitable number of recessed channels 32. Further, the recessed channels 32 may comprise various shapes, such that they can receive a variety of manicuring items, such as, nail polish bottles or nail shaping tools. In the illustrated embodiment, the panel 29 further includes a cushion member 33 disposed along an edge at a second end 34 of the panel 29, wherein the cushion member 33 extends substantially the entire width of the panel 29. The cushion member 33 is configured to receive a wrist of a user. In the illustrated embodiment, the cushion member 33 comprises a rounded shape. However, in an alternative embodiment, the cushion member 33 may have any suitable shape, such as, square or rectangular. The cushion member 33 provides support to the wrist of a user, such that the wrist and a hand of the user can remain in a comfortable position when performing a manicure using the panel 29.

Figure 2:
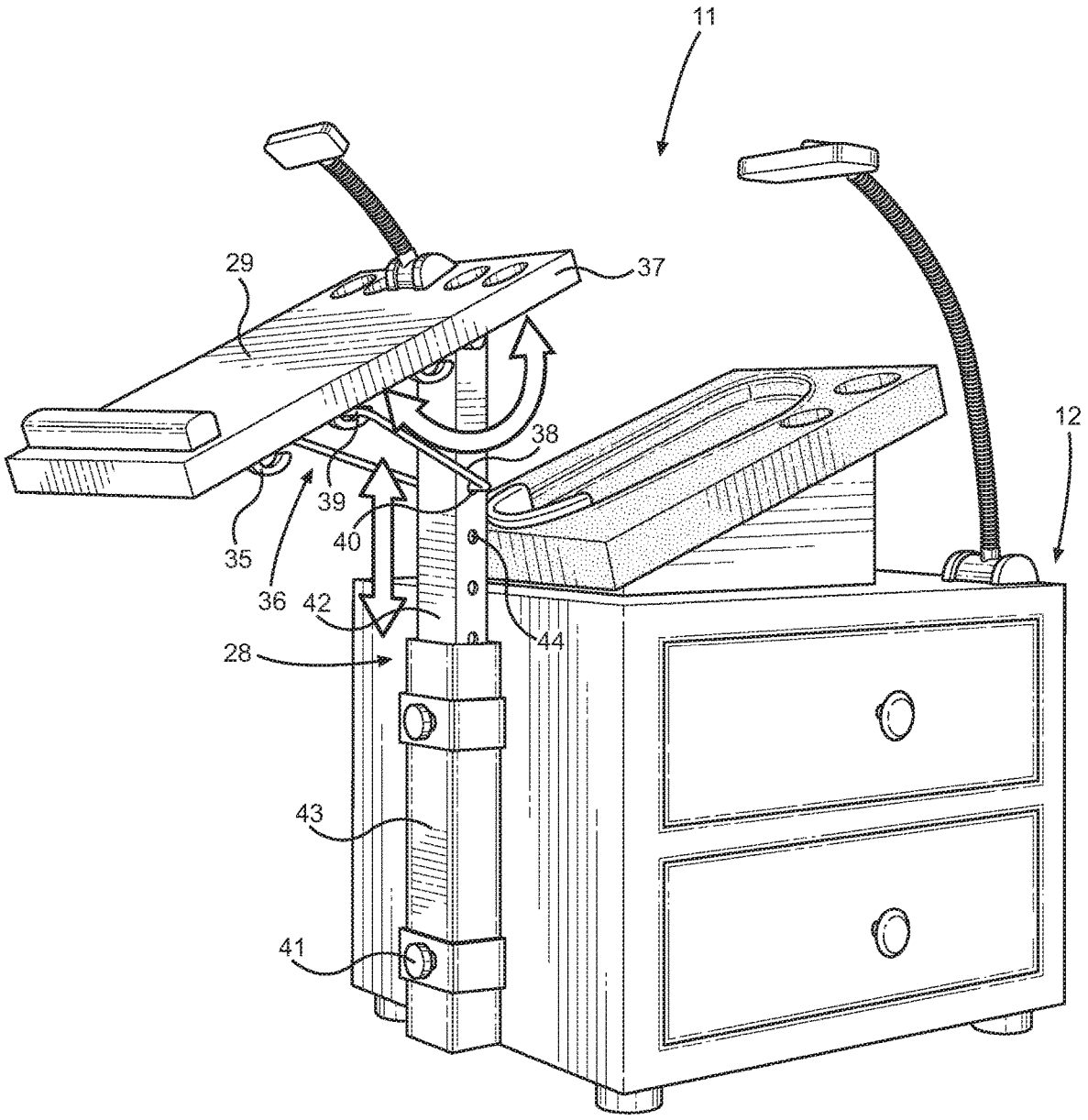
FIG. 2 shows a perspective view of an embodiment of the combination manicure and pedicure station, wherein the panel is in an extended configuration.
Figure 3:
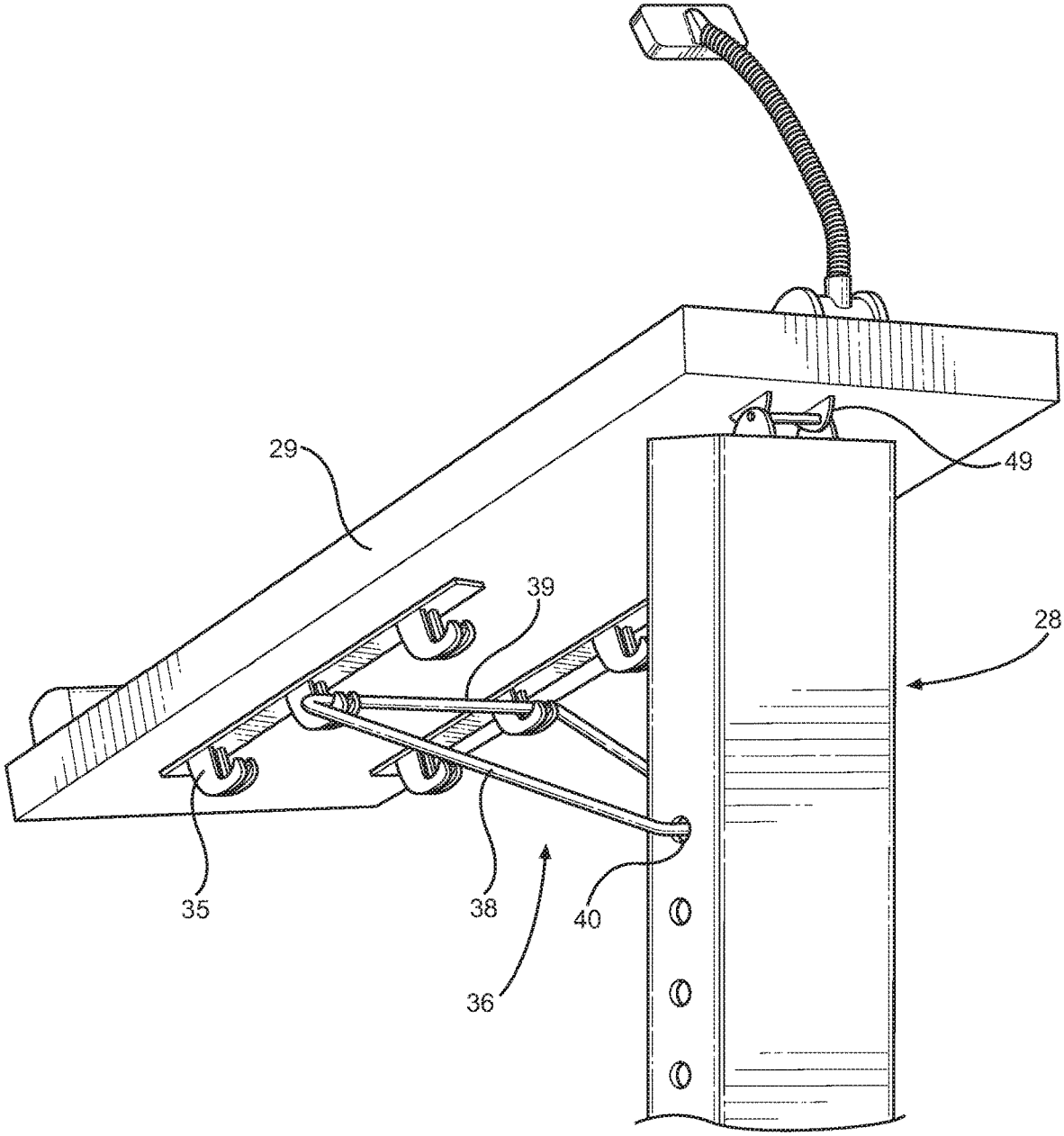
FIG. 3 shows a bottom perspective view of an embodiment of the panel, wherein an adjustment rod is disposed within a pair of fasteners.

Referring now to FIGS. 2 and 3, there is shown a perspective view of an embodiment of the combination manicure and pedicure station, wherein the panel is in an extended position, and a bottom perspective view of an embodiment of the panel, wherein an adjustment rod is disposed within a pair of fasteners, respectively. In the illustrated embodiment, the stand 28 of the station 11 is hingedly affixed to a first end 37 of the panel 29 via a hinge 49. The panel 29 includes a plurality of fasteners 35 disposed on a bottom surface thereof. The fasteners 35 are configured to receive an adjustment rod 36 that is hingedly mounted to the stand 28, such that the adjustment rod 36 and fasteners 35 are configured to position the panel 29 at various angles. When in the stored configuration, a longitudinal axis of the panel 29 is disposed in parallel with the stand 28. When in the extended configuration, the longitudinal axis of the panel 29 is disposed at various angles extending outwardly from the stand 29.

In the illustrated embodiment, the adjustment rod 36 comprises a U shape, wherein two arms 38 extend perpendicularly from an elongated member 39. The distal ends of the arms 38 are hingedly affixed to the stand 28 within an aperture 40. In the illustrated embodiment, three pairs of fasteners 35 are disposed at equal distances from each other on each lateral side of the bottom surface of the panel 29. The fasteners 35 are configured as hooks, wherein each pair of fasteners 35 is configured to receive the elongated member 39 of the adjustment rod 36. In use, the adjustment rod 36 can be placed in any of the three pairs of fasteners 35 providing three varying angled positions for the panel 29. This allows a user to adjust the panel 29 to the most comfortable and appropriate position when performing a manicure.

In the illustrated embodiment, the stand 28 is slidably secured to the housing 12 via a pair of adjustable brackets 41. The brackets 41 allow the stand 28 and panel 29 to be completely removed from the housing 12 when preforming a pedicure. Further, the stand 28 is configured to be telescopically adjustable in height via a plurality of fasteners 44, such that a first member 42 is received and removably secured within an interior volume of a second member 43 at varying heights. In the illustrated embodiment, the plurality of fasteners 44 of the stand are configured as a spring driven pin and aperture arrangement, wherein the spring driven pin protrudes from within the interior volume of the second member 43 and is received by an aperture 44 disposed within the first member 42. This arrangement allows the first member 42 to be quickly raised in the vertical direction to position the panel at a preferred height.

Figure 4:
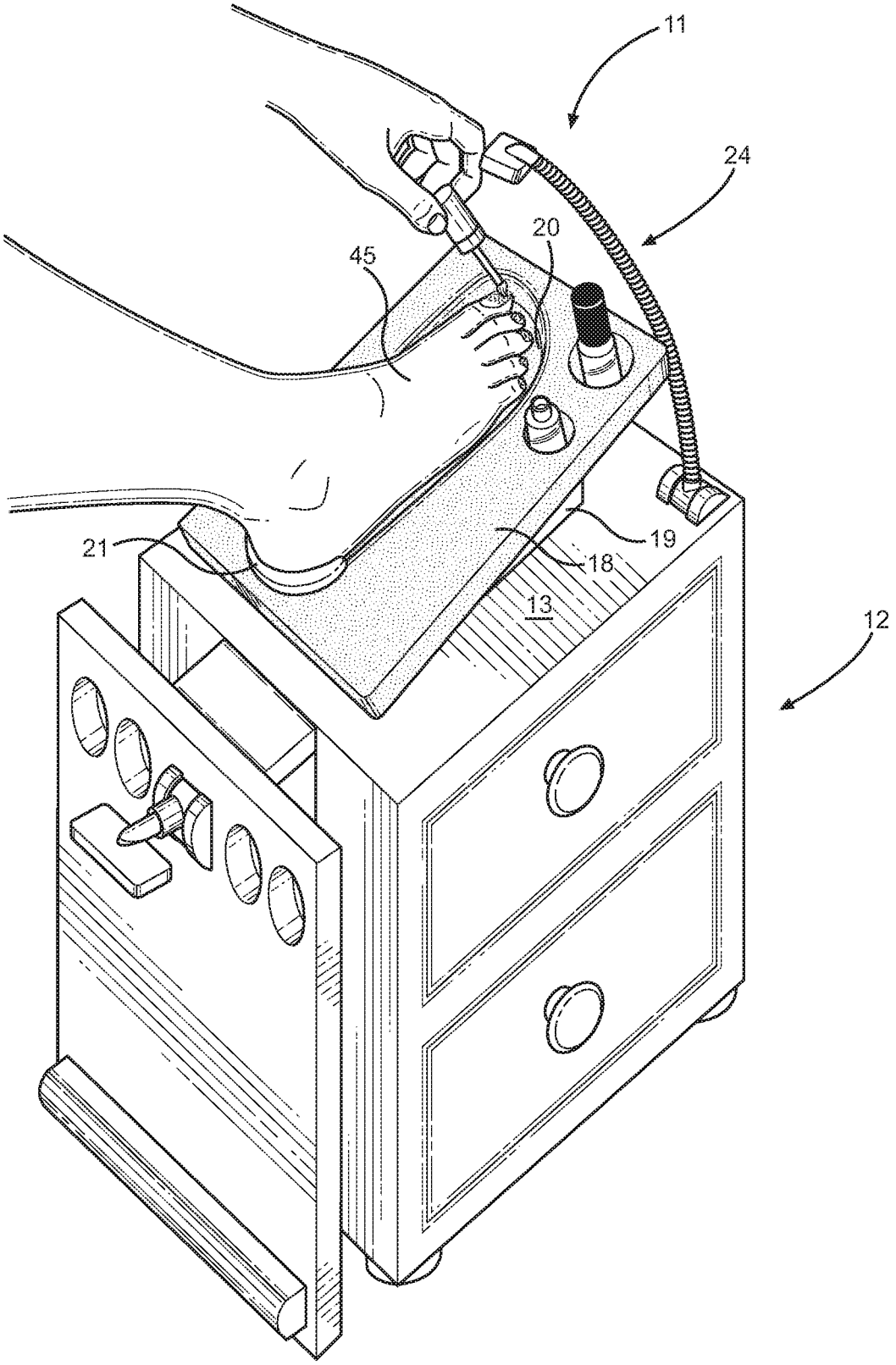
FIG. 4 shows a perspective view of an embodiment of the combination manicure and pedicure station, wherein the pedestal receives a foot.

Referring now to FIG. 4, there is shown a perspective view of an embodiment of the combination manicure and pedicure station, wherein the pedestal receives a foot. The pedestal 18 of the station 11 is configured to receive a foot 45 of a user. In the illustrated embodiment, the foot 45 is received within the recessed portion 20 of the pedestal 18. This recessed portion 20 secures the foot 45 therein, such that when performing a pedicure, the foot 45 remains still, thereby placing the foot 45 in an workable position. Further, the cushion member 21 of the recessed portion 20 provides support to the heel of the foot 45, thereby providing comfort to the user, allowing the user to perform a prolonged pedicure. In the illustrated embodiment, the angled support member 19 is configured to place the pedestal 18 at an angle greater than 15 degrees above the top surface 13 of the housing 12. This angle provides further comfort to the user by placing the foot 45 in an easily accessible position, wherein the user can apply products to the foot, such as, nail polish. However, in alternative embodiments, the angled support member 19 may be configured to position the pedestal 18 at any suitable angle. Further, when performing a pedicure, the first adjustable light 24 disposed on the top surface 13 of the housing 12 can be extended over the foot 45, thereby providing illumination to the entire foot 45. This provides a user with increased lighting which is essential when precisely applying nail polish to a toe.

Figure 5:
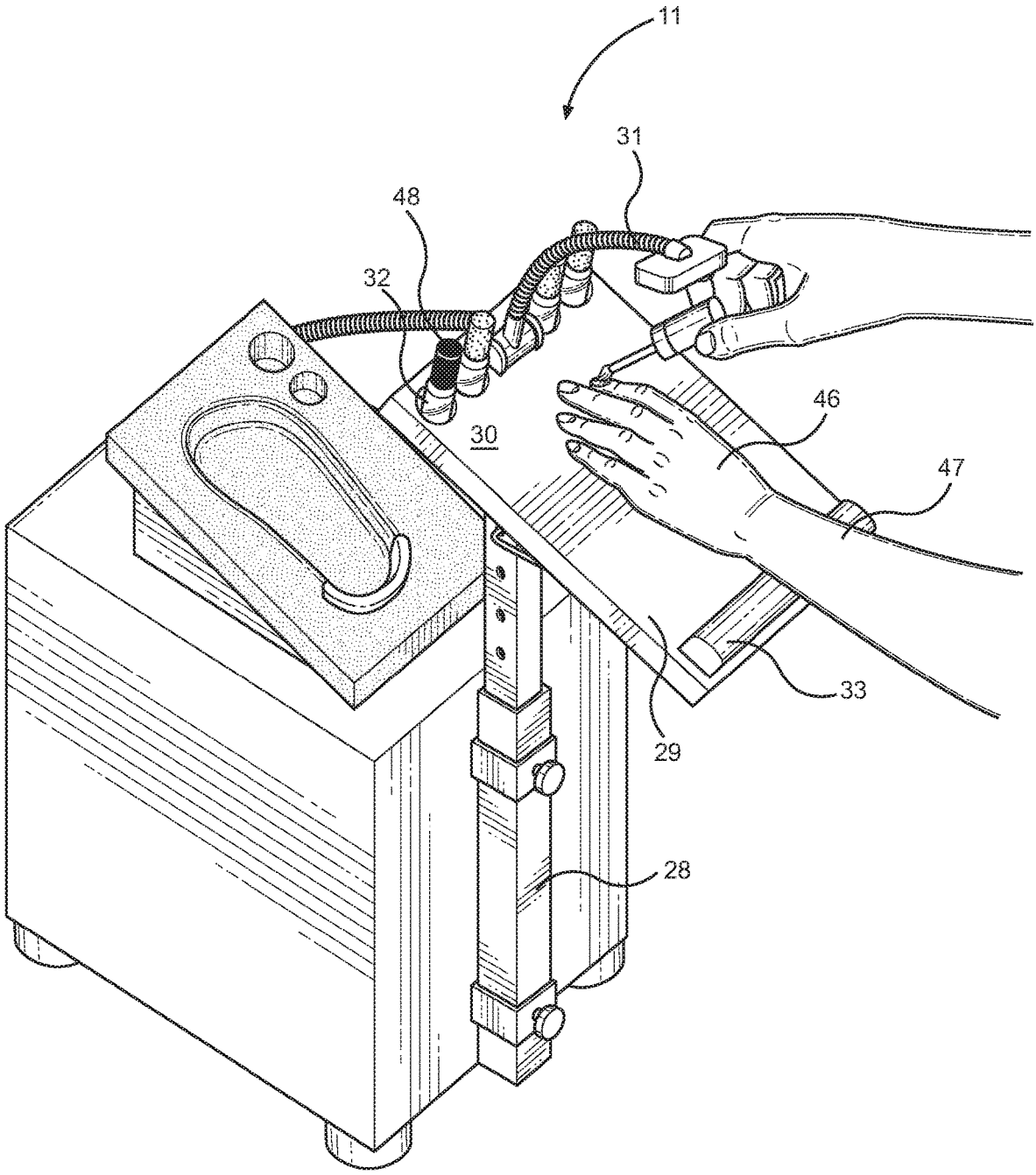
FIG. 5 shows a perspective view of an embodiment of the combination manicure and pedicure station, wherein the panel receives a hand.

Referring now to FIG. 5, there is shown a perspective view of an embodiment of the combination manicure and pedicure station, wherein the panel receives a hand. In the illustrated embodiment, the panel 29 of the station 11 is positioned in an extended position to receive a hand 46 of a user. Further, the stand 28 is set at a desired height such that the hand 46 is placed in a workable position. In use, a wrist 47 of a user is placed on the cushion member 33 of the panel 29, while the hand 46 is placed on the top surface 30 of the panel 29. The cushion member 33 supports the wrist 47 and allows the user to comfortably perform a manicure. In the illustrated embodiment, a plurality of nail polish bottles 48 are stored within the at least one recessed channels 32 of the panel 29. This allows a user to place the necessary items within reach when performing a manicure. Further, the second adjustable light 31 is positioned such that it illuminates the hand 46 of the user. Increased lighting allows the user to easily see a fingernail of the hand 46, such that the user can meticulously apply nail polish to thereto.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination manicure and pedicure station, comprising:

a housing having a top surface including a sidewall forming an enclosed interior volume and a base;

at least one drawer slidably mounted within the housing;

a pedestal mounted to an angled support member, wherein the angled support member is affixed to the top surface of the housing;

wherein the angled support member comprises a planar lower end secured flush against the top surface and an angled upper end secured to the pedestal, such that the pedestal is disposed along a non-parallel plane relative to a plane of the top surface;

wherein a recessed portion is disposed within the pedestal, the recessed portion dimensioned to receive a foot therein;

a stand slidably affixed to the sidewall; and a panel hingedly affixed to the stand.

2. The combination manicure and pedicure station of claim 1, wherein the recessed portion includes a cushion member disposed on a sidewall thereof, wherein the cushion member is configured to receive a heel.

3. The combination manicure and pedicure station of claim 1, wherein the pedestal further includes a recessed channel configured to receive a container.

4. The combination manicure and pedicure station of claim 3, wherein at least two recessed channels are disposed in the pedestal, wherein each recessed channel comprises a different diameter.

5. The combination manicure and pedicure station of claim 1, wherein the housing further includes a first adjustable light disposed on the top surface, wherein the first adjustable light is configured to illuminate the pedestal.

6. The combination manicure and pedicure station of claim 5, wherein the first adjustable light comprises a flexible neck affixed to the top surface at a proximal end and a light source disposed on a distal end of the flexible neck.

7. The combination manicure and pedicure station of claim 1, wherein the panel includes a plurality of fasteners disposed on a bottom surface thereof, wherein the plurality of fasteners are configured to receive an adjustment rod hingedly mounted to the stand, such that the adjustment rod and the plurality of fasteners are configured to position the panel at various angles.

8. The combination manicure and pedicure station of claim 7, wherein the plurality of fasteners are disposed in two rows along the bottom surface of the panel, wherein a distance between the two rows is greater than a width of the stand, such that a longitudinal axis of the panel is parallel to the stand when in a stored configuration.

9. The combination manicure and pedicure station of claim 1, wherein the panel further includes a second adjustable light configured to illuminate a top surface of the panel.

10. The combination manicure and pedicure station of claim 9, wherein the second adjustable light is selectively movable between and extended position and a retracted position.

11. The combination manicure and pedicure station of claim 1, wherein a top surface of the panel further includes a recessed channel configured to receive a container.

12. The combination manicure and pedicure station of claim 1, wherein the stand is hingedly affixed to a first end of the panel.

13. The combination manicure and pedicure station of claim 1, wherein the panel further includes a cushion member disposed at a second end of the panel, wherein the cushion member is configured to receive a wrist of a user.

14. The combination manicure and pedicure station of claim 1, wherein the stand is telescopically adjustable in height via a plurality of fasteners, such that a first member is received and removably secured within an interior volume of a second member at varying heights.

15. The combination manicure and pedicure station of claim 1, wherein the base of the housing includes a plurality of footings disposed on a bottom surface thereof.

16. The combination manicure and pedicure station of claim 1, wherein the stand is disposed on the sidewall orthogonal to the drawer.

17. The combination manicure and pedicure station of claim 1, wherein the angled support member positions the pedestal at an angle greater than 15 degrees.

18. The combination manicure and pedicure station of claim 1, wherein a bracket removably secures the stand to the housing.

19. The combination manicure and pedicure station of claim 1, wherein the pedestal comprises a greater cross-sectional area than the upper end of the angled support member, such that the pedestal overhangs the angled support member.

* * * * *